US008142037B2

(12) United States Patent
Hering et al.

(10) Patent No.: US 8,142,037 B2
(45) Date of Patent: Mar. 27, 2012

(54) RIBBON CABLE LIGHTING FOR A WATER-BEARING HOUSEHOLD APPLIANCE

(75) Inventors: Reinhard Hering, Holzheim (DE); Sebastian Wagner, Glött (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 173 days.

(21) Appl. No.: 12/532,196

(22) PCT Filed: Apr. 1, 2008

(86) PCT No.: PCT/EP2008/053867

§ 371 (c)(1),
(2), (4) Date: Sep. 21, 2009

(87) PCT Pub. No.: WO2008/125480

PCT Pub. Date: Oct. 23, 2008

(65) Prior Publication Data

US 2010/0033949 A1 Feb. 11, 2010

(30) Foreign Application Priority Data

Apr. 12, 2007 (DE) ..... 10 2007 017 273

(51) Int. Cl.
*B08B 3/00* (2006.01)
*F21V 33/00* (2006.01)

(52) U.S. Cl. ..... 362/89; 362/253; 362/800; 134/113; 68/3 R

(58) Field of Classification Search ..... 362/89, 362/91, 94, 253, 800; 134/58 DL, 56 D, 134/57 D, 113; 62/264; 68/3 R
See application file for complete search history.

(56) References Cited

U.S. PATENT DOCUMENTS

| | | | | |
|---|---|---|---|---|
| 3,619,592 | A | 11/1971 | Lamb, Jr. et al. | |
| 4,899,264 | A * | 2/1990 | Ries et al. | 362/92 |
| 5,870,787 | A * | 2/1999 | Choi | 8/159 |
| 6,074,074 | A | 6/2000 | Marcus | |
| 6,505,955 | B1 | 1/2003 | Hatjasalo et al. | |
| 7,380,559 | B2 * | 6/2008 | Son et al. | 134/56 D |
| 7,948,765 | B2 * | 5/2011 | Schroetlin | 361/760 |
| 8,016,444 | B2 * | 9/2011 | Cho et al. | 362/91 |
| 2004/0179350 | A1 * | 9/2004 | Ortega | 362/89 |
| 2005/0286246 | A1 * | 12/2005 | Coon et al. | 362/235 |
| 2006/0158882 | A1 | 7/2006 | Klomp et al. | |
| 2007/0223226 | A1 * | 9/2007 | Park | 362/267 |
| 2007/0272085 | A1 * | 11/2007 | Ghassemlou et al. | 99/282 |
| 2008/0025022 | A1 | 1/2008 | Schinzel et al. | |
| 2009/0044846 | A1 | 2/2009 | Rosenbauer et al. | |
| 2009/0153057 | A1 | 6/2009 | Cho et al. | |

FOREIGN PATENT DOCUMENTS

| | | |
|---|---|---|
| DE | 19649039 C1 | 4/1998 |
| DE | 19838497 A1 | 3/2000 |
| DE | 10048088 A1 | 4/2002 |

(Continued)

*Primary Examiner* — Peggy A. Neils
(74) *Attorney, Agent, or Firm* — James E. Howard; Andre Pallapies

(57) ABSTRACT

A water-bearing household appliance such as a dishwashing machine is provided with a housing having a housing edge which defines a washing compartment opening and with a washing compartment which is enclosed by the housing and which is defined by the housing. A seal is provided onto which a device door can be closed to abut the seal and the dishwashing machine has lighting elements arranged in the area between the housing edge and the seal for illuminating the washing compartment.

20 Claims, 3 Drawing Sheets

FOREIGN PATENT DOCUMENTS

| | | | |
|---|---|---|---|
| DE | 10234395 | A1 | 2/2004 |
| DE | 202005018998 | U1 | 3/2006 |
| DE | 202006001844 | U1 | 6/2006 |
| EP | 0148775 | * | 11/2000 |
| EP | 1192893 | A2 | 4/2002 |

* cited by examiner

RIBBON CABLE LIGHTING FOR A WATER-BEARING HOUSEHOLD APPLIANCE

BACKGROUND OF THE INVENTION

Water-bearing household appliances of the prior art, e.g. washing machines and in particular dishwashers, are generally unlit. The disadvantage of this is that the user always requires a light source outside the appliance in order to check the load. For loading or unloading a dishwasher, for example, it must be ensured that the area where the appliance is installed has adequate lighting. On the other hand, a light source outside the appliance is also required e.g. for filling the salt dispenser which is generally located inside the washing compartment. The user of such appliances often finds it difficult to perform certain operations inside a dishwasher or washing machine, such as cleaning or filling any tanks, etc., precisely because no interior light source is provided.

Interior-lit water-bearing household appliances are already known in the prior art. DE 100 48 088 A1 claims a method for detecting the load of a dishwasher. To carry out this method, a dishwasher is used in which a light source and, opposite the light source, a photodetector are positioned in the area of the door opening inside the washing compartment in order to create a light barrier. The type of light source is not specified. In addition, this embodiment of the prior art has the disadvantage that a light curtain that is as homogeneous as possible must be generated for the light barrier to work. This means a relatively expensive light source requiring a relatively large amount of space, which has a negative effect on the loading capability of the crockery baskets. Another disadvantage of the dishwasher of DE 100 48 088 A1 is that the light sources proposed there are only designed to produce a light barrier and therefore not for lighting the washing compartment. As a preferred embodiment a rod-shaped light source is proposed, the disadvantage of this again being the relatively large amount of space required.

DE 10 2004 051 174 A1 discloses a water-bearing household appliance in which a light source is disposed outside the treatment chamber. In the context of the cited prior art, this means that the light source is disposed in the door of the appliance. This has the disadvantage that the washing compartment can only be poorly lit. Add to this the fact that, being disposed in the appliance door, the light source is located in the wet area during the washing process and it is therefore necessary to ensure that the power supply for the light source is adequately sealed, thereby resulting in more complex processing and increased costs.

BRIEF SUMMARY OF THE INVENTION

The object of the present invention is therefore to provide a water-bearing household appliance which at least partly eliminates said disadvantages of the prior art.

This object is achieved by an illuminated water-bearing household appliance according to the appended claims. The sub-claims relate to preferred embodiments which can be used individually or in combination with one another.

The invention specifically relates to a water-bearing household appliance, in particular a dishwasher, having a housing with a housing edge which defines a washing compartment opening, and having a washing compartment enclosed by the housing and defined by the housing and by a seal and which can be tightly shut by an appliance door which can be positioned at the seal, and having lighting means disposed in the area between housing edge and seal for illuminating the washing compartment. It is provided according to the invention that lighting means are connected to a ribbon cable. The advantage of such an illuminated household appliance is, on the one hand, that an interior light source makes it easier to perform operations inside the appliance, e.g. to clean the washing compartment or fill the salt and rinse aid dispensers. On the other hand, a particularly impressive aesthetic effect can be achieved by such lighting. A particular advantage of the present invention is that it uses ribbon cables for mounting and powering the lighting means.

Light-emitting diodes disposed on circuit boards are already known in the prior art, e.g. from DE 10 2004 004 777 A1. The disadvantage, however, is the large amount of space required for the circuit boards even when they can be interconnected by ribbon cable.

Ribbon cables consist of a plurality of insulated conductor wires running parallel to one another on a flat plane. Ribbon cables therefore require less space and can be laid flat anywhere in the interior of a dishwasher. It is even possible to mount the ribbon cable inside the washing compartment, i.e. in the wet cell. The ribbon cable or cables are preferably disposed horizontally or vertically in a U-shaped or annularly circumferential manner outside or inside the washing compartment.

It is preferable for the ribbon cable to be mounted outside the washing compartment, i.e. in an area that is not part of the wet area. The washing compartment or wet area is the area which is wetted during the washing process.

A water-bearing household appliance according to the present invention is based on conventional appliances having a washing compartment opening which is defined by a housing edge and can be sealed by an appliance door. Normally such an appliance door is fitted precisely into the washing compartment opening and even extends partially into the interior of the housing, thereby achieving better sealing. In order to be able to insert the appliance door tightly into the washing compartment opening, a seal is generally provided which is located some distance from the housing edge inside the housing and defines the washing compartment. An area of the housing is therefore available which is located between the seal and the washing compartment and which is not part of the wet zone. This area is concealed by the appliance door when the latter is closed. Preferably, the housing edge is expediently provided with a flange which facilitates installation.

It is preferably provided that the lighting means are connected to uncut conductors of the ribbon cable, i.e. the lighting means are not connected to bare conductor ends of the ribbon cable. An electrically conductive connection can be provided by soldering the lighting means directly onto the uncut conductors of the ribbon cable, the insulation covering the individual conductors of the ribbon cable being melted as part of the soldering process and the electrically conductive connection established.

The ribbon cable is disposed directly adjacent to the seal in the area between the seal and the housing edge. It can be disposed inside the housing or outside. However, it is preferably disposed outside, with recesses in the housing ensuring that the lighting means can illuminate the interior of the washing compartment.

As lighting means, basically all types of lighting means that can be mounted on a ribbon cable can be used. However, LEDs are preferred. It is possible to mount, on a ribbon cable, LEDs which emit light of difference colors. However, blue or red or white emitting LEDs are preferably used.

The number of LEDs per centimeter or square centimeter of cable can be adapted to suit the application. There are virtually no limitations here. However, if a single row of LEDs is used on the cable, at least 1 LED, preferably 2, preferably 3 to 4 per 50 centimeters are preferably used. In the case of broader ribbon cables, the LEDs can also be disposed in a plurality of rows, a number of at least one LED per 30, preferably 20, preferably 10, preferably 6 preferably 4 square centimeters being preferred.

In a particularly preferred embodiment, 2 LEDs are used for the entire upper edge of a dishwasher.

In addition to the lighting means, other electronic components are also preferably disposed on the ribbon cable. These are preferably Surface Mounted Devices (SMDs) which can be used, for example, to control the supply of current. A Hall sensor and possibly a transistor are preferably used as SMDs. The Hall sensor is suitable for controlling the lighting such that the lighting means are only supplied with power when the appliance door is open. Preferably, recesses are also provided for the electronic components in the housing.

The recesses can preferably also incorporate mounts with a drill hole in which in the lighting means and electronic components can be locked into place. This type of mounting enables the current-carrying cable to be disposed outside the housing, while the lighting means merely project through the recesses, possibly in a corresponding mount, thereby enabling the washing compartment to be optimally lit without running the risk of the lighting means being wetted by water.

To enable the lighting means to be supplied with power, a T-shape is particularly preferred for the ribbon cable. The cross-member of the T is provided with the lighting means and electronic components, while the longitudinal member leads to a power source. This allows simple and space-saving installation. However, the ribbon cable can also be used in tape form, e.g. it can be disposed around the housing in a U-shaped or annularly circumferential manner.

A water-bearing household appliance according to the present invention has the advantage that particularly space-saving and aesthetic lighting can be achieved.

A ribbon cable is also part of the invention.

BRIEF DESCRIPTION OF THE DRAWINGS

The invention will now be explained in greater detail with reference to preferred embodiments and the accompanying schematics in which.

DETAILED DESCRIPTION OF EXEMPLARY EMBODIMENTS OF THE PRESENT INVENTION

Figure 1:
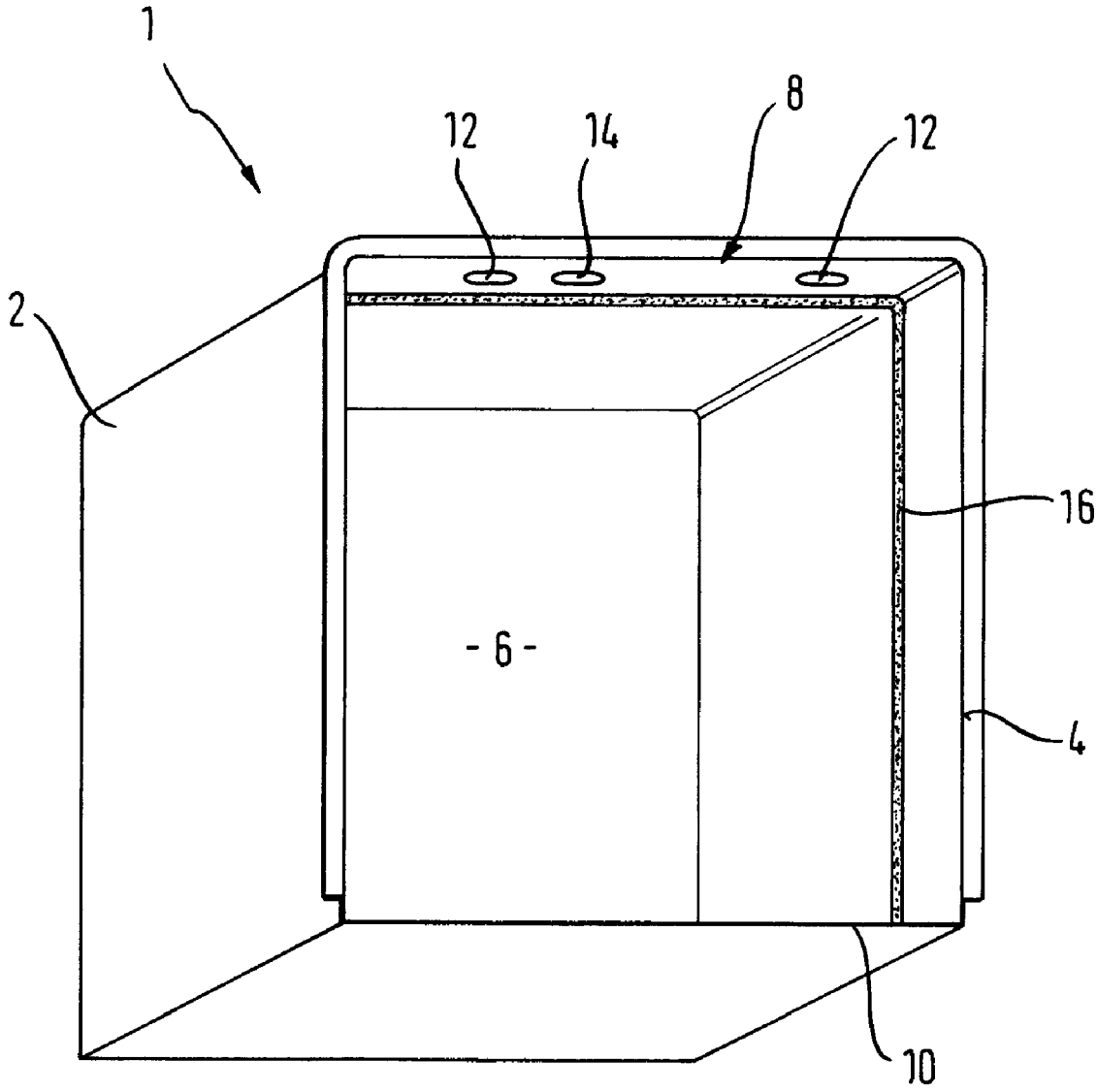
FIG. 1 shows a perspective view of the housing of a dishwasher according to the invention in the open state without appliance door.

In the following description of the Figures, the same reference characters will be used to denote identical or comparable elements.

FIG. 1 shows a perspective view of the housing 2 of a dishwasher 1 according to the invention, in the open state. The appliance door is not shown. The dishwasher has a housing 2 which encloses a washing compartment 6. The essentially cuboidal housing 2 opens to the front, so that the interior of the washing compartment 6 is accessible through said washing compartment opening 8. The washing compartment opening 8 has the dimensions of the front wall of the housing 2 and can be sealed by an appliance door (not shown ) which is disposed on a hinge 10. The washing compartment opening is defined by a housing edge 4 which, in the embodiment shown, has an edge area in the shape of a flange. Likewise shown is a seal 16 disposed circumferentially inside the housing 2 in the area of the washing compartment opening 8. When the appliance door is shut, is closes off the washing compartment along the seal 16. The washing compartment 6, which represents the wet zone of the dishwasher, is therefore delimited by the seal 16.

Located on the upper side of the housing 2 in the area adjacent to the washing compartment opening and outside the washing compartment, i.e. between the seal 16 and the housing edge 4, are recesses for the lighting means 20 which are disposed on the inventively usable ribbon cable 18. In the embodiment shown in FIG. 1, it is provided to mount the ribbon cable 18 outside the housing so that the lighting means can be fitted into the recesses 12.

Figure 2:
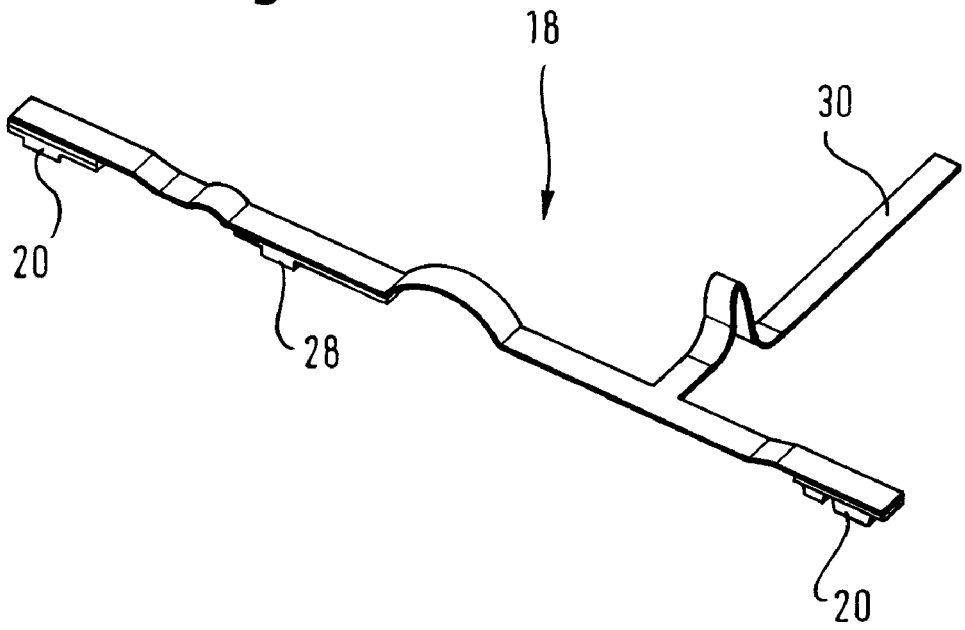
FIG. 2 shows a perspective view of a ribbon cable suitable for the invention, with lighting means.

FIG. 2 shows a perspective plan view of an inventively usable ribbon cable 18 in the form of a T. Mounted on the underside of the cross-member of the T of the ribbon cable 18 are two LEDs 20, namely on the outer edges of the cable 18 in each case. More centrally located is another electronic component 28, in this case a Hall sensor, a transistor and various resistors. The Hall sensor is likewise mounted to the underside of the cable 18. The cable 18 also has a longitudinal member 30 which connects the cable to the power supply. Said ribbon cable 18 is designed to be externally disposed on the housing according to FIG. 1, wherein the LEDs 20 and the other electrical component 28 can be brought out through the recesses 12, 14, thereby enabling them to illuminate the washing compartment.

Figure 3:
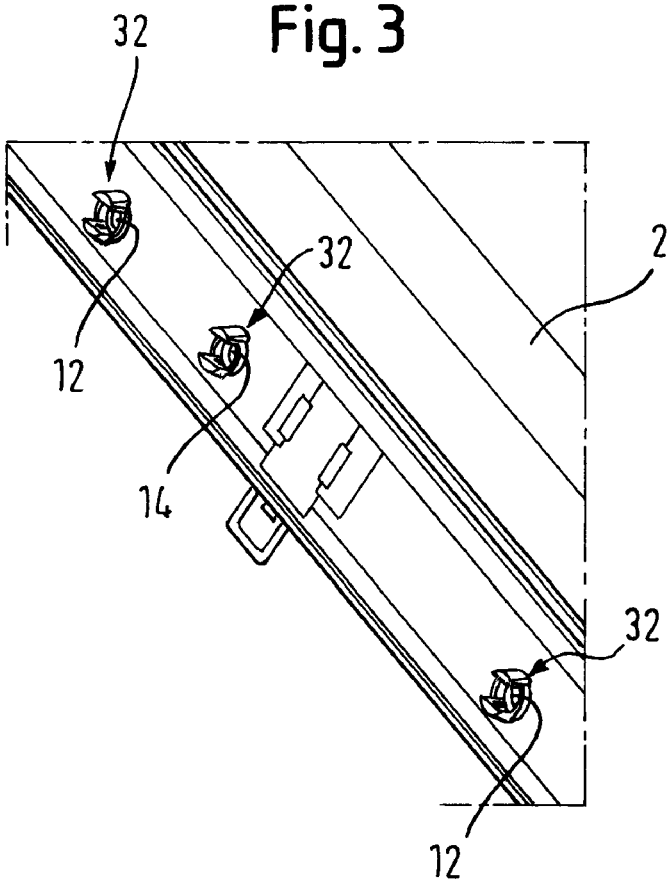
FIG. 3 shows a perspective view of a section of the housing of a dishwasher according to the invention.

FIG. 3 shows a section of the housing 2 as it is also schematically illustrated in FIG. 1. Again visible are the recesses 12, 14 for the LEDs 20 or another electronic component 28. Also shown in this embodiment is a mount 32 which can be inserted in the recesses 12, 14. The mount has a drilled hole which can accommodate an LED 20 or an electronic component 28.

Figure 4:
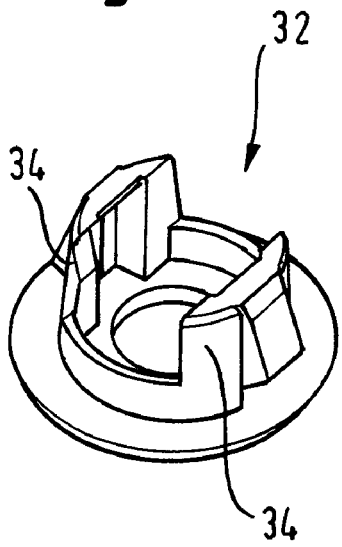
FIG. 4 shows a mount for fixing the lighting means.

FIG. 4 shows an enlarged perspective view of a mount 32. The mount has supporting ribs 34 into which an LED 20 or electronic component 28 can be inserted and locked in place.

Figure 5:
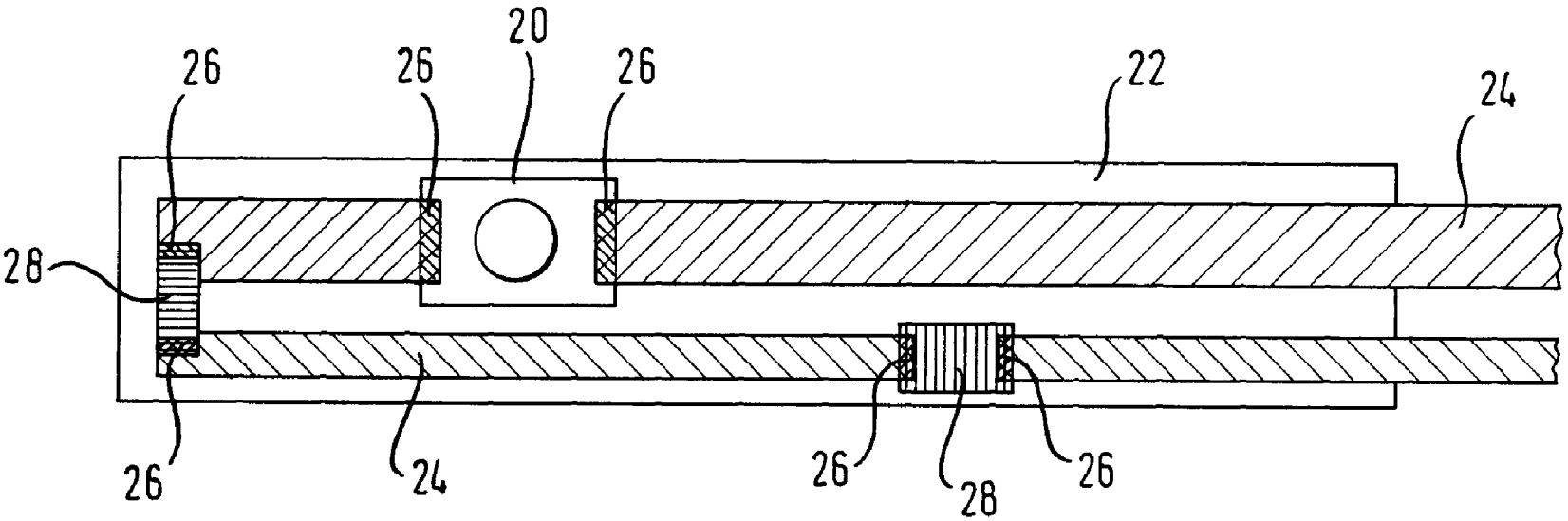
FIG. 5 shows a plan view of a ribbon cable suitable for the invention.

FIG. 5 shows a plan view of a ribbon cable 18 suitable for the invention, with LEDs 20. The ribbon cable shown consists of conductors 24 which are embedded in an insulating material 22. Likewise shown are LEDs 20 and other electronic components 28. The LEDs 20 are soldered directly onto the conductors 24. This also applies to the electronic components 28. In this case the devices are so-called Surface Mounted Devices (SMDs). In particular, a Hall sensor and a transistor are provided so that the supply of current for the LEDs can be controlled, e.g., so that the lighting is activated only when the appliance door is opened.

LIST OF REFERENCE CHARACTERS

1 water-bearing household appliance, particularly dishwasher
2 housing
4 housing edge
6 washing compartment
8 washing compartment opening
10 hinge for appliance door
12 recess for lighting means
14 recess for electronic components

16 seal of washing compartment
18 ribbon cable
20 lighting means, light-emitting diodes (LEDs)
22 insulating material
24 conductors
26 solder joints
28 electronic component, SMD, Hall sensor, transistor
30 line to power supply
32 mount for lighting means or electronic components

The invention claimed is:

1. A water-bearing household appliance, the water-bearing household appliance comprising:

a housing having a housing edge that delimits a washing compartment opening;

a washing compartment that is enclosed by the housing;

an appliance door;

a seal, the seal being positioned to be in sealing engagement with the appliance door in a closed door position in which the appliance door closes the washing compartment opening; and a lighting element located in an area between the housing edge and the seal and operable to provide illumination, the lighting element being connected to at least one ribbon cable having a plurality of insulated conductors running parallel to one another in a substantially flat plane.

2. The water-bearing household appliance as claimed in claim 1, wherein the lighting element is connected to one or more of the conductors of the ribbon cable.

3. The water-bearing household appliance as claimed in claim 1, wherein the at least one ribbon cable incorporates other electronic components in addition to being connected to the lighting element.

4. The water-bearing household appliance as claimed in claim 3, wherein the other electronic components include a Hall sensor.

5. The water-bearing household appliance as claimed in claim 1, wherein the at least one ribbon cable is disposed outside the washing compartment.

6. The water-bearing household appliance as claimed in claim 1, wherein the housing also has an electric component receiving portion that at least includes recesses for electronic components.

7. The water-bearing household appliance as claimed in claim 6 and further comprising a lighting element mounting portion that at least includes a mount disposed in one of the recesses for mounting the lighting element.

8. The water-bearing household appliance as claimed in claim 1, wherein the at least one ribbon cable is disposed at one of the top or a side of the housing.

9. The water-bearing household appliance as claimed in claim 1, wherein the at least one ribbon cable is in the shape of the letter T with the lighting element being secured to a portion of the at least one ribbon cable forming a cross member of the letter T and a power source being connected to another portion of the at least one ribbon cable forming a longitudinal member of the letter T.

10. The water-bearing household appliance as claimed in claim 1, wherein the lighting element includes a plurality of light emitting diodes (LEDs).

11. The water-bearing household appliance as claimed in claim 1, wherein the lighting element includes a plurality of components secured on the at least one ribbon cable at a density of at least one component per 50 cm of ribbon cable.

12. The water-bearing household appliance as claimed in claim 1, wherein the lighting element is capable of emitting colored light.

13. A ribbon cable comprising:

a plurality of insulated conductor wires running substantially parallel to one another in a substantially flat plane; and a connection location at which a lighting element is connected to the conductor wires, the lighting element being mounted in a water-bearing household appliance, that includes a housing having a housing edge that delimits a washing compartment opening, a washing compartment that is enclosed by the housing, an appliance door, and a seal, the seal being positioned to be in sealing engagement with the appliance door in a closed door position in which the appliance door closes the washing compartment opening, with the lighting element being located in an area between the housing edge and the seal and operable to provide illumination.

14. The ribbon cable as claimed in claim 13, wherein the appliance is a dishwasher.

15. The water-bearing household appliance as claimed in claim 1, wherein the appliance is a dishwasher.

16. The ribbon cable as claimed in claim 13, wherein the lighting element is surface mounted to at least one uncut conductor of the plurality of conductor wires of the ribbon cable.

17. The water-bearing household appliance as claimed in claim 1, wherein the lighting element is surface mounted to at least one uncut conductor of the plurality of conductors of the ribbon cable.

18. A ribbon cable for a water bearing household appliance, said ribbon cable comprising:

a plurality of insulated conductor wires running substantially parallel to one another in a substantially flat plane and;

a lighting element to light an inner compartment of the water bearing household appliance, the lighting element being surface mounted to at least one uncut conductor wire of the plurality of conductor wires by soldering the lighting element directly onto the at least one uncut conductor wire, the insulation covering the at least one uncut conductor wire being melted as part of the soldering process and an electrically conductive connection established, said conductor wires adapted to support and power the lighting element.

19. The ribbon cable as claimed in claim 18, further comprising at least an electronic component surface mounted to said conductor wires.

20. The ribbon cable as claimed in claim 18, wherein the at least one ribbon cable is in the shape of the letter T with the lighting element being secured to a portion of the at least one ribbon cable forming a cross member of the letter T and a power source being connected to another portion of the at least one ribbon cable forming a longitudinal member of the letter T.

* * * * *